US006290493B1

(12) United States Patent
Pirard et al.

(10) Patent No.: US 6,290,493 B1
(45) Date of Patent: Sep. 18, 2001

(54) GRATE PLATE FOR COOLER

(75) Inventors: Regnier Pirard, Nessonvaux; Bruno Wolan, Fleron, both of (BE)

(73) Assignee: Magotteaux International, Vaux-sous-Chevremont (BE)

( * ) Notice: Subject to any disclaimer, the term of this patent is extended or adjusted under 35 U.S.C. 154(b) by 0 days.

(21) Appl. No.: 09/622,752

(22) PCT Filed: Feb. 9, 1999

(86) PCT No.: PCT/EP99/00935

§ 371 Date: Oct. 10, 2000

§ 102(e) Date: Oct. 10, 2000

(87) PCT Pub. No.: WO99/44001

PCT Pub. Date: Sep. 2, 1999

(30) Foreign Application Priority Data

Feb. 24, 1998 (BE) ..... 9800143

(51) Int. Cl.[7] ..... F27D 15/02

(52) U.S. Cl. ..... 432/77; 432/78; 432/80; 126/163 R

(58) Field of Search ..... 432/77, 78, 80; 110/268, 281; 126/163 R, 167

(56) References Cited

U.S. PATENT DOCUMENTS 4,460,333 * 7/1984 Longaretti ..... 432/80
4,600,098 * 7/1986 Orren ..... 432/58

FOREIGN PATENT DOCUMENTS

4103866-A1 * 8/1992 (DE) .

* cited by examiner

*Primary Examiner*—Jiping Lu
(74) *Attorney, Agent, or Firm*—Schmeiser, Olsen & Watts

(57) ABSTRACT

A plate globally shaped like an upturned caisson with a bearing surface (10) for supporting and driving forward a bulk material layer to be cooled with a cooling gas passing through the platex. The plate front part **(10*b*), viewed in the material forward motion direction, is formed with overlapping flanges (14) sloping upwards and defining transverse cavities (20) in the bearing surface and the overlapping parts of two adjacent flanges (14) defining narrow channels (22)** for the cooling gas to pass through.

12 Claims, 2 Drawing Sheets

GRATE PLATE FOR COOLER

FIELD OF THE INVENTION

The present invention relates to a grate plate for a cooler of loose material leaving a kiln and having the overall shape of an inverted tray with a bearing surface for supporting and advancing a layer of material that is to be cooled with the aid of a cooling gas passing through the said plate.

Such coolers are particularly used in cement works for cooling the clinker as it comes out of the kiln. These plates are grouped in transverse rows with an overlap between their forward parts and the rear parts of the preceding rows so as to form a tiered cooling plane. The progress of the material to be cooled is usually effected by an alternating arrangement of fixed rows and moving rows, the latter being moved back and forth in the direction of progress of the material.

Some existing plates have a smooth surface along their full length with openings for the passage of the cooling gas. Although these plates have the advantage of simplicity and a small manufacturing cost, they have the disadvantage of a short working life. It should be realized that these plates come under intense wear. There is first of all the wear by abrasion generated by the friction due to the relative movement between the plates and the material to be cooled. There is also oxidative wear due to the high temperatures of as much as 1400° C. of the material as it leaves the kiln.

In order to improve wear resistance, plates have been designed with pockets in the forward parts which do not overlap and which are therefore directly in contact with the material. As they fill up, these pockets form material/material interfaces which should reduce the abrasive wear, given that cooled material remains in these pockets and protects them from the hot moving material. One such plate is described in document EP 0 337 383 B1.

Even so, the exposed surfaces between the pockets remain comparatively large. In addition, the path of the cooling gas is labyrinthine, which causes a head loss and reduces the ability to cool both the material and the plate. The result is that in practice, plates with pockets have a working life which is hardly any longer than that of plates with a smooth surface. Document DE 41 03 866 discloses a grate plate that has a corrugated surface with openings for the passage of cooling air in the corrugations. This plate has the disadvantage that the material to be cooled slides rapidly over the corrugations, which are therefore exposed to severe abrasion. Furthermore, the plate is insufficiently cooled by the cooling air.

SUMMARY OF THE INVENTION

The object of the present invention is to provide a new grate plate for a cooler which will provide more efficient cooling, both of the material to be cooled and of the plate itself and, as a consequence, a longer service life.

To achieve this object, the plate provided by the present invention is characterized in that the forward part of the plate, viewed in the direction of progress of the material, consists of overlapping gills sloping upwards and defining transverse cavities in the bearing surface and in that the overlapping parts of two adjacent gills define narrow channels for the passage of the cooling gas.

These channels preferably have a longitudinal section in the form of a rounded bend with an angle of less than 90° opening vertically in the underside of the bearing surface and obliquely in the bottom of each cavity.

These channels give better guidance to the cooling gases and a more direct passage with little head loss. The tangential entry of the gases into the bottom of the cavities further ensures efficient cooling of the gills, which enhances the wear resistance of the grates.

The surfaces directly exposed to wear are small and limited to the edge of the plate and to the upper ridges of the gills, the rest being protected by material remaining in the cavities where it forms material/material interfaces.

The upper forward edge of each gill is preferably in the form of a transverse vertical rib.

The plane of the part consisting of gills may slope upwards relative to the plane of the smooth rear part of the plate.

BRIEF DESCRIPTION OF THE DRAWINGS

Other features of the invention will be found in the description of an advantageous embodiment presented below, by way of illustration, with reference to the appended drawings, in which.

DETAILED DESCRIPTION OF THE INVENTION

Figure 1:
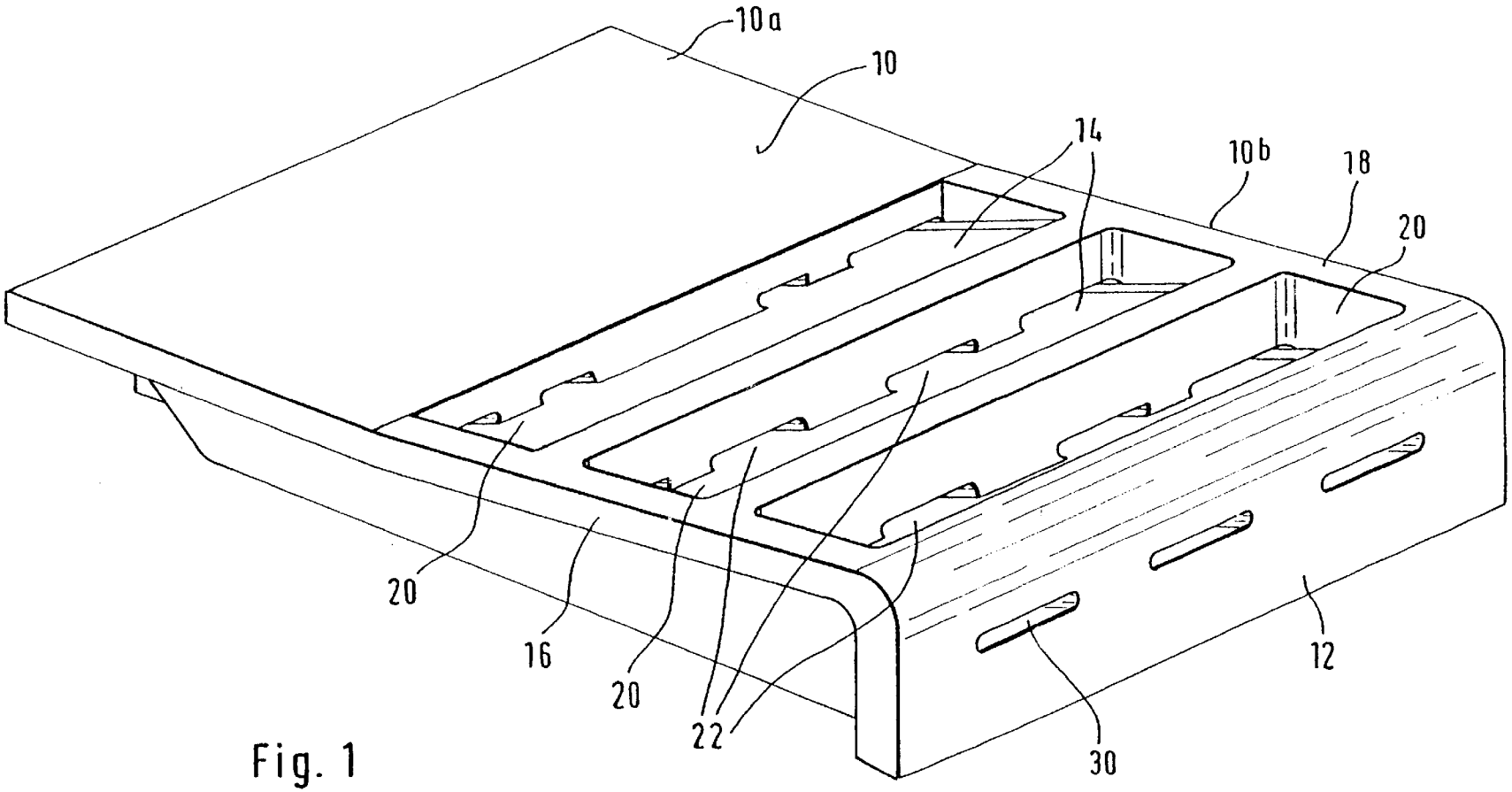
FIG. 1 is a perspective view of a plate according to the present invention and FIG. 2 is a longitudinal section through the plate on a cutting plane passing through a channel for the passage of the cooling gas.
Figure 2:
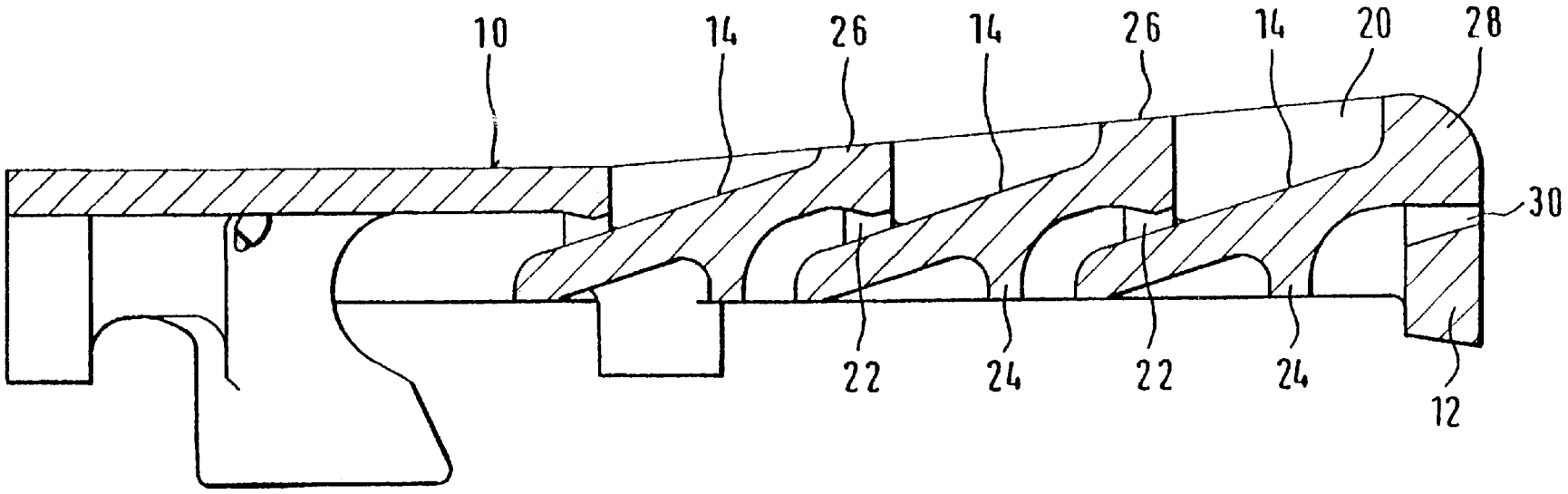

The plate depicted in FIGS. 1 and 2 comprises an upper surface 10 which terminates at the front in a vertical forward edge 12. The upper surface 10 comprises a smooth region 10*a* at the rear which is engaged under the forward region of the plate behind (not shown) in addition to a forward region 10*b* positioned on top of the rear region 10*a* of the plate situated in front. Consequently, when the plates are grouped in successive rows, it is essentially the regions 10*b* that are exposed to the material to be cooled, while the regions 10*a* are exposed only partly in the course of the back-and-forth movement.

In the example illustrated, the region 10*b* slopes gently upwards in the direction of progress of the material, relative to the plane of the rear region 10*a*. However, the invention also applies when both regions 10*a* and 10*b* are in the same plane.

In accordance with the present invention, the forward region 10*b* consists of several oblique overlapping gills 14 extending transversely between the longitudinal edges 16 and 18. These gills define transverse cavities 20 between themselves which retain the material to be cooled and thus form material/material interfaces.

The overlapping parts of two adjacent gills 14 define narrow elongate channels 22 for the passage of the cooling gas. Between the channels 22, the gills 14 may be connected to each other.

Each gill 14 also comprises, on its underside, a round-edged transverse rib 24 defining, with the rounded edge of the preceding gill 14, a vertical entry into each channel 22, as well as a channel bend with gentle curvature. This form of the channels 22 provides ideal guidance for the cooling gases with the least possible head loss.

The number of gills 14 and the number of channels may vary with the size of the plates.

The upper forward edge of each gill 14 may be constructed in the form of a transverse vertical rib 26. These ribs 26 retard the progress of the material and thus improve its cooling.

The forward edge 28 of the first gill 14 is rounded and also forms the forward edge of the plate. The forward front edge 12 of each plate also comprises outlet apertures 30 for the cooling gases.

What is claimed is:

1. Grate plate for a cooler of loose material leaving a kiln and having the overall shape of an inverted tray with a bearing surface (10) for supporting and advancing a layer of material that is to be cooled with the aid of a cooling gas passing through the said plate, comprising; a forward part **(10*b*) of the plate, viewed in the direction of progress of the material, includes overlapping gills (14) sloping upwards and defining transverse cavities (20) in the bearing surface and in that the overlapping parts of two adjacent gills (14) define narrow channels (22) for the passage of the cooling gas and in that the said channels (22) have a longitudinal section in the form of a rounded bend with an angle of less than 90° opening vertically in an underside of the bearing surface and obliquely in the bottom of each of said cavaties (20)**.

2. Plate according to claim 1, characterized in that each gill (14) comprises, on its under surface, a round-edged transverse rib (24) that defines, with the rounded rear edge of the preceding gill, a vertical entry into each channel (22).

3. Plate according to claim 2, characterized in that the plane of the part **(10*b*) consisting of gills (14) slopes upwards relative to the plane of the smooth rear part (10*a*)** of the plate.

4. Plate according to claim 3, characterized in that the transverse forward side (12) of the plate is vertical and comprises outlet apertures (30) for the cooling gas.

5. Plate according to claim 2, characterized in that the transverse forward side (12) of the plate is vertical and comprises outlet apertures (30) for the cooling gas.

6. Plate according to claim 1, characterized in that the upper forward edge of each gill (14) is in the form of a transverse vertical rib (26).

7. Plate according to claim 6, characterized in that the plane of the part **(10*b*) consisting of gills (14) slopes upwards relative to the plane of the smooth rear part (10*a*)** of the plate.

8. Plate according to claim 7, characterized in that the transverse forward side (12) of the plate is vertical and comprises outlet apertures (30) for the cooling gas.

9. Plate according to claim 6, characterized in that the transverse forward side (12) of the plate is vertical and comprises outlet apertures (30) for the cooling gas.

10. Plate according to claim 1, characterized in that the plane of the part **(10*b*) consisting of gills (14) slopes upwards relative to the plane of the smooth rear part (10*a*)** of the plate.

11. Plate according to claim 10, characterized in that the transverse forward side (12) of the plate is vertical and comprises outlet apertures (30) for the cooling gas.

12. Plate according to claim 1, characterized in that the transverse forward side (12) of the plate is vertical and comprises outlet apertures (30) for the cooling gas.

* * * * *